US005483505A

United States Patent [19]

Cartier

[11] Patent Number: 5,483,505

[45] Date of Patent: Jan. 9, 1996

[54] QUICK-FIXING DEVICE FOR A WATCHBAND

[75] Inventor: Christian Cartier, Maiche, France

[73] Assignee: Mauboussin, S.A., Paris, France

[21] Appl. No.: 290,750

[22] PCT Filed: Dec. 14, 1993

[86] PCT No.: PCT/CH93/00279

§ 371 Date: Aug. 11, 1994

§ 102(e) Date: Aug. 11, 1994

[87] PCT Pub. No.: WO94/14105

PCT Pub. Date: Jun. 23, 1994

[30] Foreign Application Priority Data

Dec. 15, 1992 [CH] Switzerland ..... 3817/92

[51] Int. Cl.[6] ..... G04B 37/00

[52] U.S. Cl. ..... 368/282; 224/164

[58] Field of Search ..... 348/281–282; 224/164–180; 24/265 B, 265 WS

[56] References Cited

U.S. PATENT DOCUMENTS 4,564,308 1/1986 Ikegami et al. ..... 224/164

5,373,484 12/1994 Rappo et al. ..... 368/282

FOREIGN PATENT DOCUMENTS 089166 9/1983 European Pat. Off. .

9114416 2/1992 Germany .

*Primary Examiner*—Vit W. Miska

*Attorney, Agent, or Firm*—O'Connor Cavanagh

[57] ABSTRACT

A self-aligning device for attaching a watchband comprises a watch case having a cusp that includes means for positively aligning the end of a retractable spring-bar prior to retracting the end for engagement with the hole in the watch case cusp. The self-aligning device includes a semi-cylindrical depression in the lower surface of the watch cusp that engages the extended spring-bar for alignment with the engagement hole in the cusp, and may also include a second semi-cylindrical depression in the lateral face of the watch cusp to guide the retracted spring-bar from the alignment depression to the engagement hole in the watch case cusp.

8 Claims, 4 Drawing Sheets

QUICK-FIXING DEVICE FOR A WATCHBAND

The present invention relates to a quick-fixing device for a watchband and more particularly to a fixing device comprising an elastic bar one element of which is firmly connected to an operating button disposed under the watchband whose operation permits the introduction or removal of the bar, corresponding openings being formed in one of the cusps of a watchcase.

Fixing devices for watchbands are intended to permit easy replacement of watchbands. Up to now watchbands were replaced for reasons of wear or aging and these replacements were not very frequent so that the use of a quick-fixing device was not required. For several years manufacturers have proposed several types of watchbands for the same watch and replacements are becoming much more frequent to adapt different watchbands as one pleases depending on the use, the color or the fashion. It has thus become necessary for users to be able to effect a practical and quick replacement of the watchbands themselves.

Numerous forms of fixing devices for watchbands are known but they all present disadvantages. The best known and most widespread forms consist of a simple elastic bar, but these forms present the essential disadvantages of being impractical because the removal or introduction of the bar generally necessitates the use of a tool. With these known forms it is possible to remove or introduce the bar using a fingernail but the small dimension of the elements makes this very impractical and therefore inadequate for frequent replacements. Examples are known, which do not include introduction openings or positioning openings and the fixing of the bars often requires several attempts.

The objective of the present invention is thus to remedy the disadvantages of the known forms.

The objectives are reached by the principle of the invention as described by claim 1.

According to the principle of the invention, the quick-fixing device for a watchband comprises an elastic bar which includes two elements sliding in one another and subject to the action of an elastic compression member. The ends of the bar are intended to cooperate, in the service position, with holes formed in the cusps of the watchcase. This form presents numerous advantages, the most important one being the fact that the easy action of the button enables an introduction and an easy and practical disengagement of the bar which, consequently, leads to a very handsome replacement operation of the watchband elements for every user, which is especially important for frequent replacements. Another important advantage is the fact that the operating button is disposed on the underside of the watchband, i.e. between the watchband and the wrist of the user, eliminating any risk of unintentional action. According to the invention, the cusps comprise openings with forms facilitating the positioning and the introduction of the bar. The principle of the invention further present the advantage that due to the easiness of the introduction and the disengagement of the bar the device can be used as a lock by simply modifying the case.

The adjoined drawings illustrate the principle of the invention schematically and by way of example.

Figure 1:
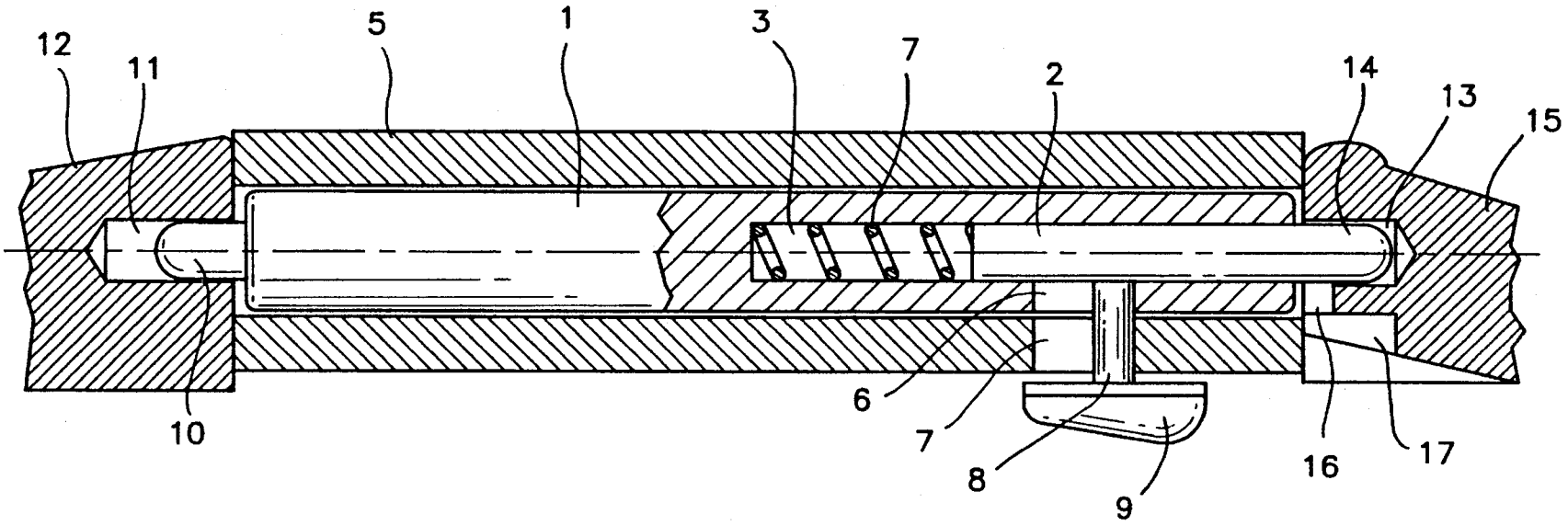
FIG. 1 is a sectional view of the quick-fixing device for a watchband, in a closed position.
Figure 2:
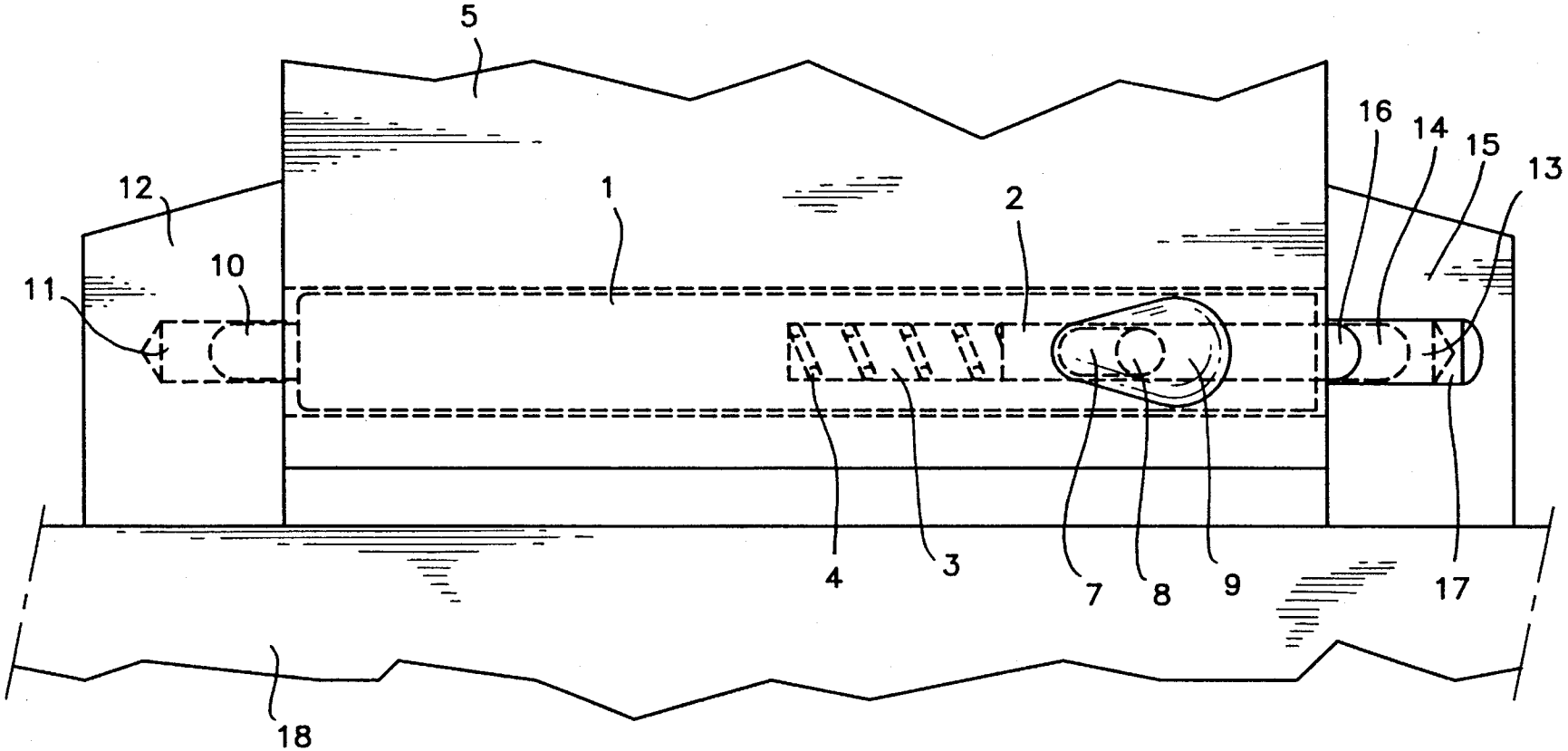
FIG. 2 is a bottom view of the fixing device in a closed position.

Referring first to FIGS. 1 and 2, an elastic bar comprises two main elements, shaft 1 and rod 2 which is slidingly mounted in cylindrical hole 3 formed in shaft 1. Elastic member 4 is mounted in cylindrical hole 3 and acts when compressed against the bottom of the cylindrical hole and against the inside end of rod 2. Elastic member 4 can comprise a spring. Shaft 1 is mounted in one of the ends of one of watchband elements 5. Shaft 1 includes rod 10 whose end has a semispherical shape. Rod 10 is intended to cooperate with hole 11 formed in the inside vertical face of a cusp with hole 12 of watchcase 18. Outside parts 14 of rod 2 is intended to cooperate, in a closed position, with hole 13 formed in the inside vertical face of a cusp with openings 15. Positioning opening 17, of semicylindrical shape, is formed in the lower horizontal face of cusp 15. End 14 of rod 2 is intended to cooperate with positioning opening 17 in the positioning position. Introduction opening 16, of semicylindrical shape, is formed in the inside vertical face of cusp 15. This introduction opening 16 is formed from the lower horizontal face of cusp 15 to hole 13.

Operating rod 8 is fixed on rod 2 perpendicular thereto. The operating rod is disposed in opening 6 formed in shaft 1 and in opening 7 formed in watchband 5. The end of operating rod 8 includes operating button 9 disposed under watchband 5 and intended to be operated by a user's finger for example.

Figure 3:
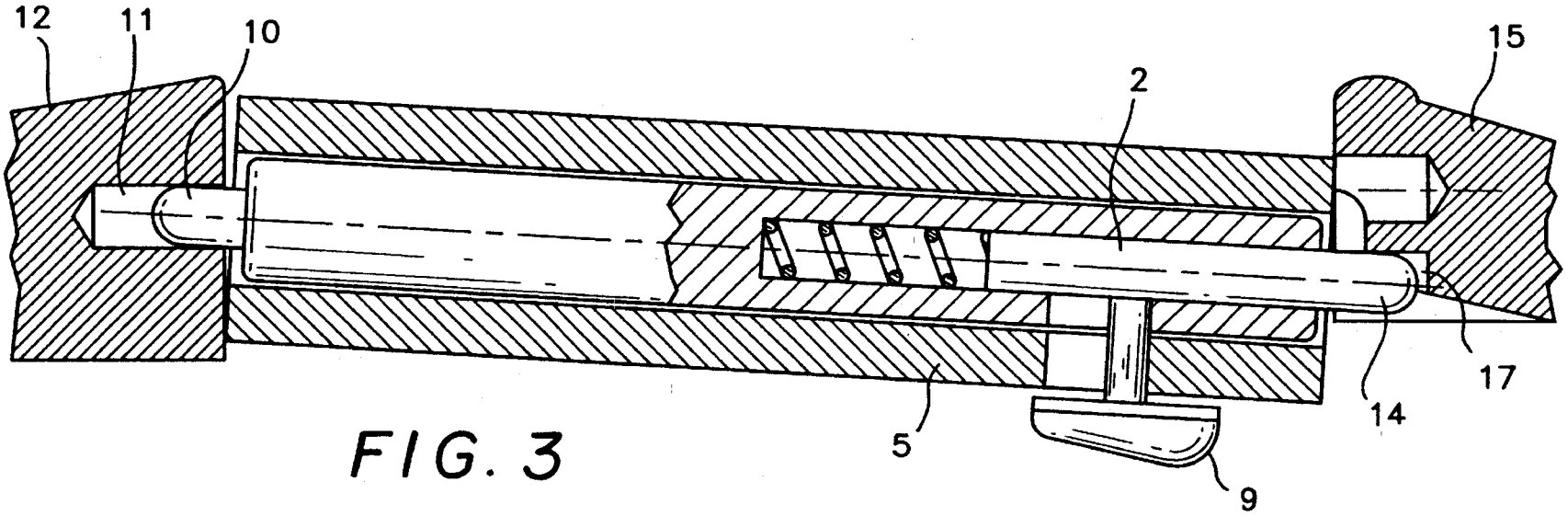
FIG. 3 is a sectional view of the fixing device in a positioning position.

FIG. 3 shows the positioning position, i.e. the position in which the user fits the end of a watchband element in the cusp of the watchcase. The first phase consists in introducing rod 10 in hole 11 of cusp 12. Pressure of a finger on watchband 5 or on button 9 causes end 14 of rod 2 to be disposed in positioning opening 17 formed in the lower horizontal face of cusp 15.

The positioning opening permits the user to find the proper introduction position easily blind.

Figure 4:
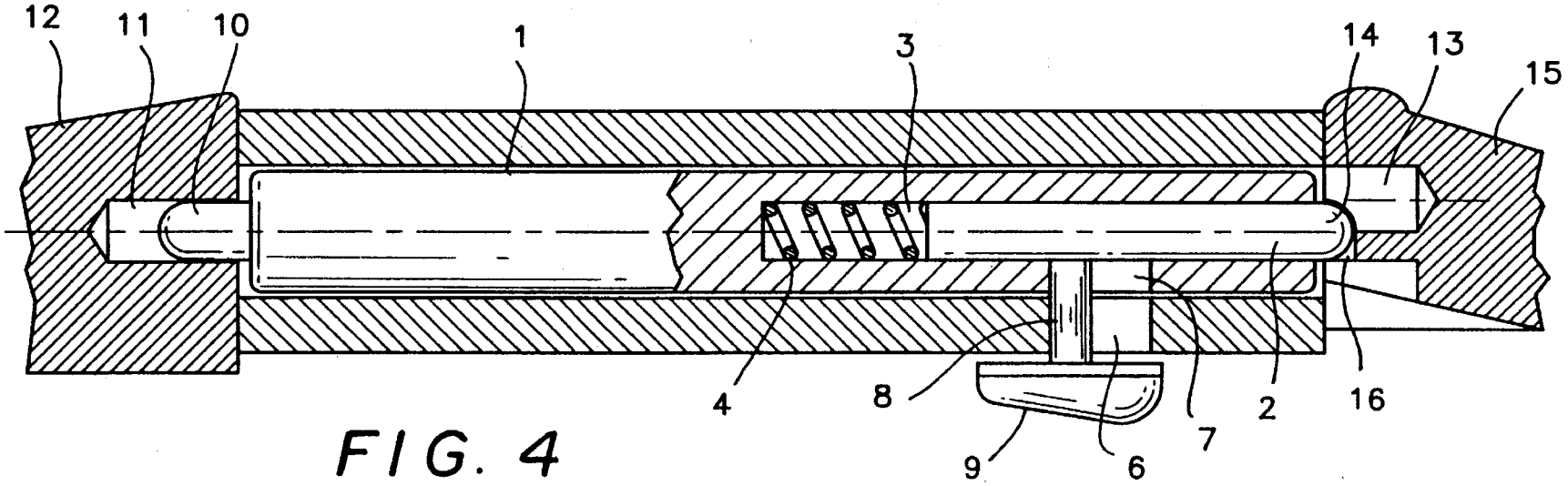
FIG. 4 is a sectional view of the fixing device in an intermediate introduction position.

FIG. 4 shows the introduction position. In this position rod 10 remains introduced in hole 11 of cusp 12. Button 9 is operated by a finger so as the make rod 2 slide toward the inside, thereby compressing elastic member 4 disposed in cylindrical hole 3. Pressure simultaneously exerted on the button upward causes end 14 of rod 2 to be introduced and maintained in position in intermediate introduction opening 16 until it is introduced in hole 13, i.e. in the closed position shown in FIGS. 1 and 2.

Referring to FIGS. 1 and 2, the watchband is removed by operating button 9 so as to disengage end 14 of rod 2 from hole 13.

Figure 5:
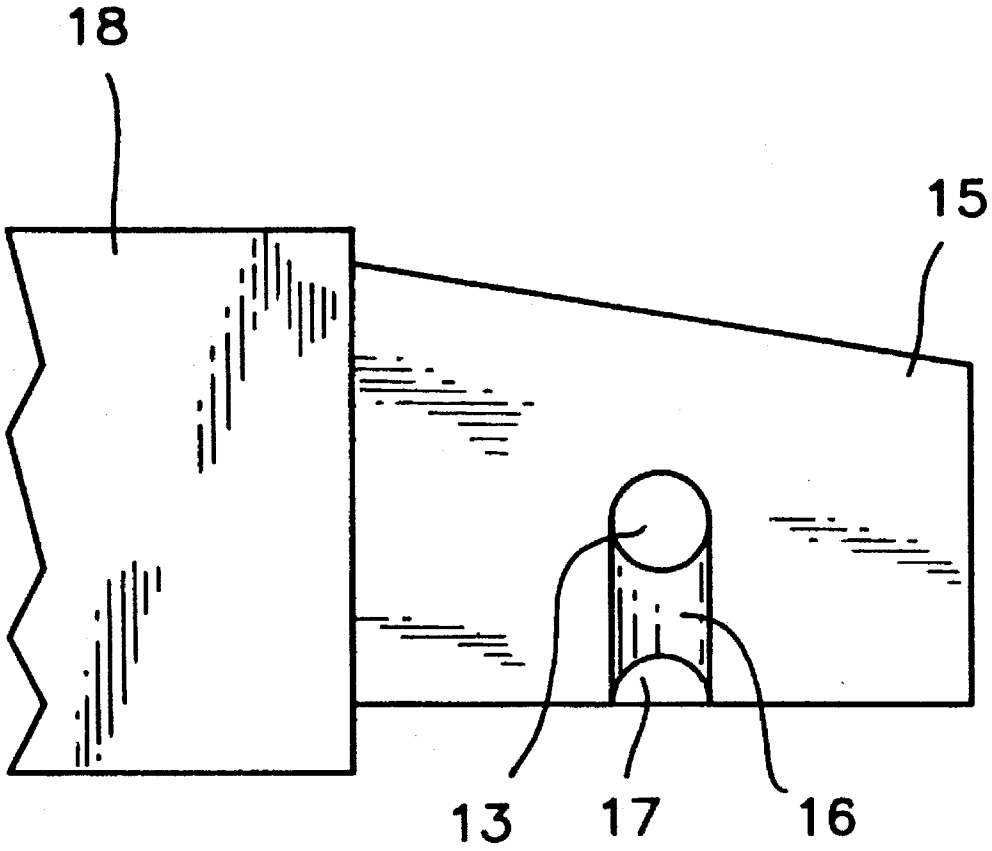
FIG. 5 is a side detail of one of the cusps constituting the fixing device.

FIG. 5 shows in detail positioning opening 17 formed in the lower horizontal face of cusp 15 firmly connected to watchcase 18, and introduction opening 16 formed in the inside vertical face of cusp 15 from the lower horizontal face of the cusp to hole 13.

The materials used for realizing the fixing device are independent of the principle of the invention. The shaft, rod, cusps and watchcase can be realized in ferrous or non-ferrous materials, precious materials such as gold for example, as well as plastics, composite or ceramic materials by way of example.

The materials used for realizing the watchband are independent of the principle of the invention, the fixing device being adaptable to all watchbands realized in a great variety of materials, taking account of the fact that if the watchbands are realized in nonworkable materials a working clearance must be provided between the watchband and the cusps.

I claim:

1. A watch case having a feature for aligning a retractable spring-bar comprising:

a watch case including a cusp, said cusp including an engagement hole for engagement with the retractable spring-bar;

means incorporated into said cusp to positively align the spring-bar in its extended condition prior to engagement of the spring-bar with said engagement hole;

whereby a watchband may be quickly attached to the watch case by first aligning the spring-bar with the engagement hole and thereafter retracting the spring-bar and engaging the engagement hole.

2. The watch case of claim 1 wherein the means for aligning the spring-bar comprises means for engaging predominantly the lateral surface of said spring-bar.

3. The watch case of claim 2 wherein said cusp further includes a lower surface;

wherein the means for engaging predominantly the lateral surface of the spring bar comprises an alignment opening, said alignment opening comprising a substantially semi-cylindrical depression formed in said lower surface for engagement with the spring-bar prior to retracting an end of the spring-bar for engagement with the engagement hole.

4. The watch case of claim 3 further including an introduction channel, said introduction channel comprising a substantially semi-cylindrical depression formed in the lateral surface of said cusp and intersecting said alignment opening and said engagement hole.

5. The watch case of claim 4 further including a second cusp having an engagement hole, wherein said introduction channel has a depth sufficient to permit an end of a retracted spring-bar to pass from the alignment opening to the engagement hole when the other end of said spring-bar is engaged in the engagement hole in said second cusp.

6. The watch case of claim 4 wherein the alignment opening and introduction channel have radii approximately equal to the cylindrical radius of the end of the spring-bar.

7. The watch case of claim 1 further including a spring-bar having a means for manually retracting an end of said spring-bar, said spring-bar having semi-spherical ends.

8. A watch case comprising:

a watch case including a plain and a self-aligning cusp said plain and self-aligning cusps having lateral faces comprising substantially parallel opposing surfaces;

the plain cusp including a plain hole normal to the lateral face of the plain cusp;

the self aligning-cusp including a self-aligning hole normal to the lateral face of the self-aligning cusp and substantially collinear with the plain hole;

the self-aligning cusp further including a lower face intersecting the lateral face of the self-aligning cusp and having a self aligning feature;

the self-aligning feature comprising an alignment opening and an introduction channel;

said alignment opening comprising a semi-cylindrical opening formed in the lower face of the self-aligning cusp;

said introduction channel comprising a semi-cylindrical opening formed on the lateral face of the self aligning cusp having an axis orthogonal to the alignment opening and intersecting the alignment opening and the self-aligning hole;

whereby a watchband may be attached to the watch case by engaging an end of a retractable spring-bar in the plain hole and engaging the opposite end of the spring-bar with the lower surface of the self-aligning cusp until the spring-bar engages the alignment opening, whereupon the spring-bar is retracted to engage the introduction channel and is moved toward the self-aligning hole until it engages the self-aligning hole to securely attach the watchband to the watch case.

* * * * *